United States Patent [19]

Kokubo et al.

[11] 4,226,253

[45] Oct. 7, 1980

[54] COIN COUNTING AND DISCHARGE MACHINE HAVING RECIPROCATING PUSHERS FOR TRANSFERRING COINS

[75] Inventors: Eiichi Kokubo; Akemi Sugai, both of Tokyo, Japan

[73] Assignee: Laurel Bank Machine Co., Ltd., Tokyo, Japan

[21] Appl. No.: 958,336

[22] Filed: Nov. 7, 1978

[51] Int. Cl.[3] ..... G07D 9/04

[52] U.S. Cl. ..... 133/4 A; 133/8 B

[58] Field of Search ..... 133/8 R, 8 B, 4 A, 5 R; 221/274; 194/10

[56] References Cited

U.S. PATENT DOCUMENTS

| | | | |
|---|---|---|---|
| 315,544 | 4/1885 | Pratt | 133/4 R |
| 626,528 | 6/1899 | Debremond | 133/5 R |
| 1,066,180 | 7/1913 | Burdick | 133/8 B |
| 2,763,272 | 9/1956 | Patzer | 133/4 R |

FOREIGN PATENT DOCUMENTS 324920 7/1968 Sweden .

*Primary Examiner*—Stanley H. Tollberg

*Attorney, Agent, or Firm*—Fleit & Jacobson

[57] ABSTRACT

A coin discharge machine wherein a plurality of cartridges, each accommodating coins of a given species, are provided and coins accumulated in at least one selected cartridge are pushed out, one at a time, from the lowermost by selected pair of rod pushers into a coin dropping outlet while each of coins being pushed is caused to be engaged with a counting arm which actuates a microswitch for counting. The pair of rod pushers integrally formed are adapted to be engaged with side portions of the coin. Each rod pusher is provided at the end thereof with a projection which is engaged with the lowermost coin in operation position and the upper surface of each rod pusher is flush with or below the surface of coin support plate for supporting the lowermost coin in the cartridge.

2 Claims, 5 Drawing Figures

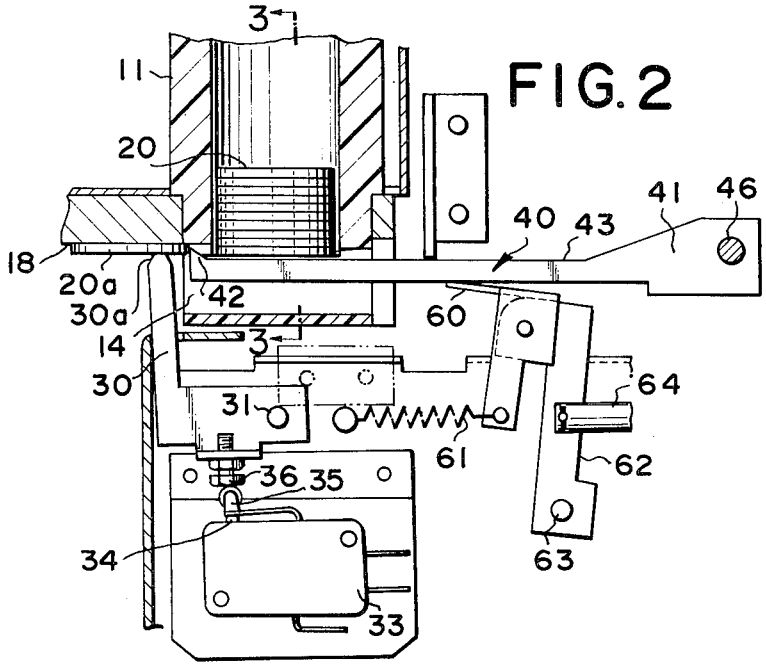
FIG. 2
FIG. 3
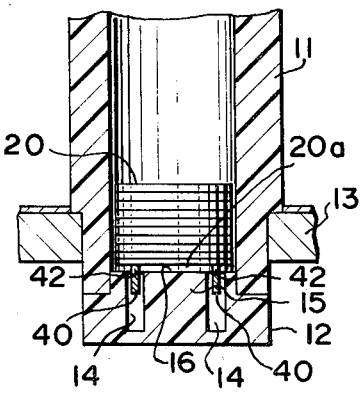
FIG. 5
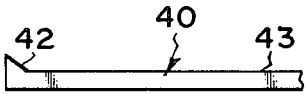
FIG. 4
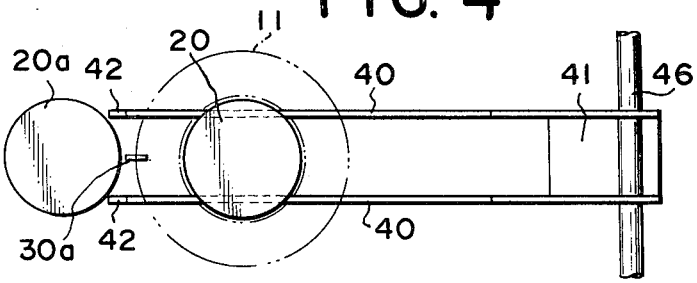

COIN COUNTING AND DISCHARGE MACHINE HAVING RECIPROCATING PUSHERS FOR TRANSFERRING COINS

BACKGROUND OF THE INVENTION

This invention relates to a coin discharge machine.

There has been known a coin discharge machine wherein a plurality of cartridges, each accommodating coins of a given species, are provided and coins accumulated in at least one selected cartridge are pushed out, one at a time, from the lowermost by a selected rod pusher into a coin dropping outlet while each of the coins being pushed is caused to be engaged with a counting arm which actuates a microswitch for counting. Each rod pusher is normally moved toward and away from the coin dropping outlet below the coins accumulated in the cartridge during nonoperation. During operation, at least one selected rod pusher is brought up to an operating position or an upper position by a biasing means and pushes the lowermost coin out of the cartridge into the coin dropping outlet.

In a conventional construction, rod pushers are of a straight form over the length thereof and a single selected rod pusher is adapted to push the lowermost coin of the coins accumulated in one selected cartridge at the center portion of the periphery of the lowermost coin. Therefore, when the rod pusher pushes the lowermost coin and separates it from the stacked coins, the remaining stacked coin ride on the rod pusher and thus the weight of the stacked coins put a load on the rod pusher. Consequently, the rod pusher is caused to be lowered against the action of a biasing means or a select arm. This means that the rod pusher disengages from the coin being pushed and does not push the coin any further.

Further, in a conventional construction, the count arm for counting the number of the pushed coins is usually disposed just behind the cartridge so that the coin being pushed is forced to ride on the edge of the count arm at the longitudinally center line or diametrical line of the coin. Therefore, the rod pusher which is adapted to push the center portion of the periphery of the coin should be stopped before the count arm, that is, the rod pusher cannot be moved beyond the count arm because it is obstructed by the count arm. This means that the coin being pushed sometimes is not moved sufficiently to be introduced into the coin dropping outlet and thus the coin cannot drop down because the coin is clamped between the upper surface of the coin dropping outlet or the lower surface of the frame and the edge of the count arm.

SUMMARY OF THE INVENTION

It is, therefore, a main object of the invention to provide a novel coin discharge machine which eliminates the above-mentioned disadvantages and ensures that coins accumulated in one or more selected cartridges are positively discharged one at a time and introduced into a coin dropping outlet.

It is another object of the invention to provide a coin discharge machine wherein rod pushers are not loaded with the weight of the coins accumulated in the cartridges and, therefore, are not lowered by the same in operation.

It is a further object of the invention to provide a coin discharge machine wherein at least one pair of rod pushers is used to push a coin at the side portions of the periphery thereof and, therefore, can push the coin beyond a count arm to be positively introduced into a coin dropping outlet.

It is a further object of the invention to provide a coin discharge machine wherein a simple construction capable of discharging coins is obtained.

DETAILED DESCRIPTION OF THE PREFERRED EMBODIMENT OF THE INVENTION

Figure 1:
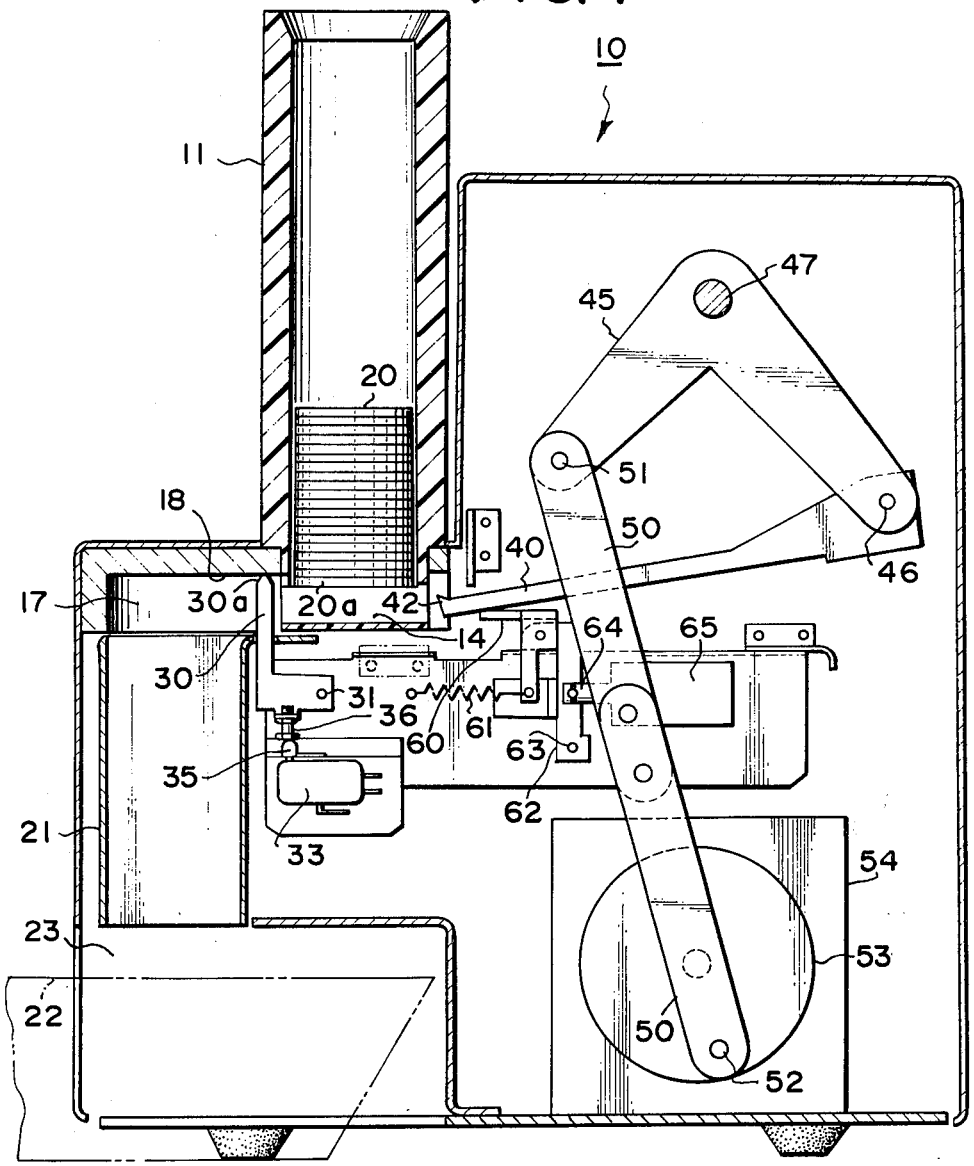

The invention will be now explained with reference to the accompanying drawings in which:

FIG. 1 is a cross-sectional view showing a coin discharge machine according to the present invention, FIG. 2 is an enlarged cross-sectional view of the main portion of FIG. 1, FIG. 3 is a cross-sectional view taken along lines 3—3 of FIG. 2, FIG. 4 is a plan view of a pair of rod pushers used in the coin discharge machine according to the invention, and FIG. 5 is a side view of one of the pair of rod pushers.

Referring now to the drawings, FIG. 1 shows a cross-sectional view of a coin discharge machine 10. The machine 10 is provided with a plurality of cartridges 11 for accommodating coins of various species so that each cartridge accommodates coins of a different species. For clarity of illustration, one of the cartridges and members associated therewith will be explained. The cartridge 11 of a hollow cylindrical form is joined at the bottom end thereof to a circular support plate 12 and is supported on the frame of the machine as shown in FIG. 3. The support plate 12 is formed with a reduced circular extension 15 upwardly coaxially of the support plate body. The support plate is also formed with two parallel grooves 14 which extend through the opposite sides thereof in a direction toward a coin dropping outlet 17 as shown in FIGS. 1 and 3. Coins to be pushed are accumulated or stacked in the cartridge 11 and the lowermost coin 20*a* is supported on the upper surface 16 of the extension 15. The lowermost coin 20*a* is pushed by a pair of rod pushers 40, which will be explained hereinafter in more detail, toward the coin dropping outlet 17 between the lower surface 18 of the frame and an edge 30*a* of a count arm 30 from the cartridge. The coin thus pushed and then introduced into the coin dropping outlet 17 falls down a discharge cylinder 21 into a carton 22 disposed in a coin receiving section 23.

The count arm 30 of L-shaped form is disposed just behind the cartridge 11 and is pivotably mounted at 31. The count arm 30 is supported on a microswitch 33 mounted on the frame of the machine so that the edge 30*a* of the count arm 30 is engaged with the lower surface 18 through adjustment of a bolt 36 riding on an actuator 35 of the microswitch 33 which serves to close contacts 34, only one of which is shown in FIG. 2. The edge of the count arm is disposed so that the coin being pushed by the pair of rod pushers is forced to ride on the edge of the count arm at the longitudinally center line or diametrical line of the coin. Therefore, when the lowermost coin 20*a* is pushed and forced to ride on the edge of the count arm and thereby to move through between the lower surface 18 of the frame 13 and the edge 30*a* of the count arm 30, the count arm is rotated in an anti-clockwise direction about a pivot 31 and thus the bolt 36 depresses the actuator 35 of the microswitch 33 to close contacts 34, giving a count.

The pair of rod pushers 40 is disposed adjacent the support plate 12 and are integrally formed with the base 41 of the rod pushers so that two rod pushers are parallel to each other. Each rod pusher is provided at the end thereof with a triangle projection 42 on the upper surface 43 of the rod pusher. The base 41 is pivotably mounted on one end of a bell crank 45 at a pivot pin 46. The bell crank 45 is pivotably mounted on the frame of the machine at a pivot 47 and the other end thereof is pivotably mounted at a pivot pin 51 on an interlocking rod 50 at one end thereof, which is in turn pivotably mounted at the other end thereof on a pin 52 mounted on the peripheral portion of a rotary member 53 of a motor 54. The rod pusher is thus moved through the groove 14 toward and away from the coin dropping outlet when the motor 54 is actuated to cause the rotary member to be rotated. In this instance, in non-operation condition or when a solenoid 65 is not actuated, which will later be explained in more detail, although the rod pusher 41 is moved toward and away from the coin dropping outlet 17, the projection 42 of the rod pusher 40 passes below the lowermost coin 20*a* and is not engaged with the same.

A select arm 60 is disposed under the pair of rod pushers 40 in engagement therewith and is biased by a tension spring 61 in an anti-clockwise direction. The select arm 60 is rigidly connected to a select bar 62 which is pivotably mounted at a pivot 63 and is connected to an actuator 64 of a solenoid 65. When at least one solenoid 65 is selectively actuated, the actuator 64 of the selected solenoid 65 causes the select bar 62 and, therefore, the select arm 60 to rotate in a clockwise direction against the action of the tension spring 61 and thereby to bring the pair of rod pushers 40 to an upper position or an operation position. In operation position, the projections 42 of the rod pushers 40 are engaged with the lowermost coin 20*a* at the side portions of the periphery thereof while the upper surfaces 43 of the rod pushers 40 are flush with or below the surface 16 of the extension 15. Therefore, the stacked coins do not put a load on the upper surfaces 43 of the rod pushers 40 since the lower surface of the lowermost coin is not supported on the upper surfaces 43 of the rod pushers but on the surface 16 of the extension 15.

In the forward stroke of the rod pushers, the selected rod pushers are brought up to the upper position or to the operation position by energizing the selected solenoid 65 and, therefore, are caused to be engaged with the lowermost coin 20*a* accumulated in the cartridge 11. The lowermost coin 20*a* is then pushed out of the cartridge into the coin dropping outlet 17. In this instance, the rod pushers can push the coin beyond the edge 30*a* of the count arm 30 and can positively introduce the coin into the coin dropping outlet 17 in which the coin thus introduced drops down the discharge cylinder 21 into the carton 22 since the edge 30*a* of the count arm 30 does not disrupt the rod pushers 40.

In operation, as shown in FIG. 1, a number of coins 20 are introduced into the cartridges 11. The lowermost coins 20*a* are supported on the surfaces 16 of the extensions 15 of the support plates 12 and, therefore, the weight of the coins is loaded on the surfaces 16. As shown in FIG. 1, while the pairs of rod pushers 40 are moved from the position shown in FIG. 1 in which the pairs of the rod pushers 40 are spaced away from the support plates toward the grooves 41 of the support plates, one or more of the solenoids 65 are selectively actuated. In this forward stroke of rod pushers, the select arm 60 thus selected brings the pair of rod pushers up to an operation position. The rod pushers enter into the grooves 14 and only the selected one or more pairs of rod pushers become engaged with the lowermost coins 20*a* at the side portions thereof by the projections 42 and push the lowermost coins 20*a* out of the cartridge while the nonselected rod pushers are not engaged with the coins. Each coin thus pushed is forced to ride on the edge 30*a* of the count arm 30 and then passes between the lower surface 18 and the edge 30*a*. Consequently, the count arm is rotated to actuate the actuator 35 of the microswitch 33 to give a count. The coin is then further pushed beyond the edge 30*a* of the count arm 30 into the coin dropping outlet 17. Thus, the coin introduced into the coin dropping outlet 17 drops down the discharge cylinder 21 into the carton 22 disposed within the coin receiving section 23.

After the rod pushers finish pushing the coin, the selected rod pushers are lowered into a non-operation position by deenergizing the solenoid 65 and are withdrawn in the backward stroke thereof. Then, the rod pushers are ready for the next cycle.

In this instance, when the rod pushers 40 push the lowermost coin out of the cartridge 11, the coin next to the lowermost coin drops onto the surface 16 of the extension 15. Therefore, the weight of the coins accumulated in the cartridge puts no load on the rod pushers and does not cause the rod pushers to be lowered. Therefore, the rod pushers can continue to push the lowermost coin until the lowermost coin is fully introduced into the coin dropping outlet.

What is claimed is:

1. A coin discharge machine for individually discharging the lowermost coin from coins stacked in a cartridge and for transferring the discharged coin to a dropping outlet, said machine comprising:

support means for supporting coins stacked in a cartridge in such manner that the lowermost coin has a portion thereof supported and spaced apart, longitudinally-extending non-supported portions;

a pair of longitudinally-extending rod pushers mounted for continuous reciprocating movement below the cartridge, each of said pushers being formed at an end thereof with an upwardly extending projection, the pushers being mounted in such manner to be movable between raised positions with the projections contacting edges of the non-supported portions of the lowermost coin and lowered positions with the projections lower than the lowermost coin;

means for axially reciprocating said pushers between the cartridge and a dropping outlet;

means for moving said pushers into said raised positions during forward strokes thereof so that said raised projections contact edges of the lowermost coin and transfer the coin to the dropping outlet, and for moving said pushers into said lowered positions during rearward strokes thereof so that said lowered projections pass beneath residual stacked coins, the residual coins being supported by said support means after removal of the lowermost coin; and counting means for counting transferred coins and including a count arm positioned between the cartridge and the dropping outlet, said count arm being disposed to be engaged by a center portion of a coin being transferred.

2. A coin discharge machine according to claim 1, wherein said support means comprises a support plate having grooves formed therein for passage of said rod pushers.

* * * * *